US008295719B2

(12) United States Patent
Nagasu et al.

(10) Patent No.: US 8,295,719 B2
(45) Date of Patent: Oct. 23, 2012

(54) APPARATUS, SYSTEM, AND METHOD OF CONTROLLING AN IMAGE PROCESSING APPARATUS

(75) Inventors: Tsuyoshi Nagasu, Ibaraki (JP); Sadanori Kobashi, Mito (JP)

(73) Assignee: Ricoh Company, Limited, Tokyo (JP)

( * ) Notice: Subject to any disclaimer, the term of this patent is extended or adjusted under 35 U.S.C. 154(b) by 284 days.

(21) Appl. No.: 12/846,180

(22) Filed: Jul. 29, 2010

(65) Prior Publication Data

US 2011/0026948 A1 Feb. 3, 2011

(30) Foreign Application Priority Data

Jul. 30, 2009 (JP) ..... 2009-178169

(51) Int. Cl.
*G03G 21/12* (2006.01)

(52) U.S. Cl. ..... 399/35; 399/358; 399/360

(58) Field of Classification Search ..... 399/35, 399/358, 360
See application file for complete search history.

(56) References Cited

U.S. PATENT DOCUMENTS

| | | | | |
|---|---|---|---|---|
| 2007/0196149 | A1* | 8/2007 | Sato et al. | 399/360 |
| 2007/0201905 | A1* | 8/2007 | Sano et al. | 399/258 |
| 2008/0008481 | A1* | 1/2008 | Takahashi et al. | 399/27 |

FOREIGN PATENT DOCUMENTS

| | | |
|---|---|---|
| JP | 11-133810 | 5/1999 |
| JP | 11-258963 | 9/1999 |
| JP | 2002-214984 | 7/2002 |
| JP | 2002-236436 | 8/2002 |
| JP | 2005-241676 | 9/2005 |
| JP | 2008-275877 | 11/2008 |

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

An image processing apparatus having a collected toner container in which residual toner is accumulated is controlled by: obtaining a supplied toner amount, obtaining a total number of printed sheets, calculating an average number of printed sheets per image forming job, calculating an average printing ratio based on the supplied toner amount, the total number of printed sheets, and the average number of printed sheets per image forming job, calculating a collected toner amount based on the average number of printed sheets per image forming job and the average printing ratio, and comparing the collected toner amount with a threshold value to generate a comparison result.

15 Claims, 5 Drawing Sheets

FIG. 5

| AVERAGE PRINTING RATIO | NUMBER OF PRINTED PAGES PER JOB | | | | | | |
|---|---|---|---|---|---|---|---|
| | 1 PAGE | 2 PAGES | 3 PAGES | 5 PAGES | 10 PAGES | 25 PAGES | 50 PAGES |
| 50.0% | 205 | 154 | 135 | 119 | 106 | 98 | 96 |
| 35.0% | 241 | 177 | 152 | 130 | 112 | 101 | 97 |
| 20.0% | 311 | 227 | 190 | 156 | 127 | 108 | 102 |
| 10.0% | 412 | 310 | 259 | 206 | 157 | 124 | 111 |
| 5.0% | 507 | 409 | 349 | 280 | 208 | 151 | 129 |
| 3.5% | 548 | 458 | 399 | 326 | 242 | 171 | 142 |
| 2.0% | 598 | 526 | 473 | 400 | 305 | 212 | 171 |
| 1.0% | 637 | 587 | 546 | 484 | 388 | 276 | 218 |
| 0.5% | 659 | 625 | 594 | 545 | 460 | 342 | 273 |

APPARATUS, SYSTEM, AND METHOD OF CONTROLLING AN IMAGE PROCESSING APPARATUS

CROSS-REFERENCE TO RELATED APPLICATIONS

This patent application is based on and claims priority under 35 U.S.C. §119 to Japanese Patent Application No. 2009-178169, filed on Jul. 30, 2009, in the Japanese Patent Office, the entire disclosure of which is hereby incorporated herein by reference.

FIELD OF THE INVENTION

The present invention generally relates to an apparatus, system, and method of controlling an image processing apparatus, and more specifically to an apparatus, system, and method of controlling replacement of a collected toner container provided in the image processing apparatus.

BACKGROUND

An image processing apparatus such as an image forming apparatus forms a toner image on an image carrier, and transfers the toner image from the image carrier onto a recording sheet. The toner that resides on the image carrier after transfer of the toner image is removed by a cleaning device and stored in a collected toner container. The collected toner container needs to be replaced with an empty collected toner container before it becomes full of the collected toner. If the collected toner container full of the collected toner is not replaced, the collected toner may overflow and contaminate a recording sheet or nearby devices within the image processing apparatus, which may further damage the device.

In order to assist an operator to replace the collected toner container before it becomes full, the amount of collected toner that is accumulated in the collected toner container needs to be obtained. For example, the collected toner container may be provided with a detector, such as an optical sensor, that detects an amount of collected toner as described in Japanese Patent Application Publication Nos. H11-133810-A and H11-174917-A. However, a detection result output by the detector may not be accurate if toner is adhered to a surface of the detector. Further, manufacturing or maintenance cost of the image processing apparatus may increase if the detector is to be provided.

Japanese Patent Application Publication No. 2005-241676 discloses a technique that calculates an amount of collected toner accumulated in the collected toner container based on information regarding toner consumption. Alternatively, the image processing apparatus may be designed to request the operator to replace the collected toner container when a toner cartridge becomes empty, based on the assumption that the collected toner container and the toner cartridge have substantially the same life cycle. These cases, however, fail to address the problem that the amount of collected toner per printing operation varies depending on the conditions under which the printing operation is performed.

For example, when the image processing apparatus prints an image with a low printing ratio according to a user instruction, the amount of toner to be transferred onto the recording sheet decreases such that the amount of collected toner increases.

In another example, when a number of pages to be printed per printing operation is small, time in which a photoconductor or a developer is rotated without feeding a recording sheet increases with respect to the overall time required for completing printing operation. This is because the photoconductor or the developer is rotated for a predetermined time period before starting actual printing operation, either at the start of the printing operation or at the end the printing operation, in order to maintain a constant level of toner density or throughput. Accordingly, the amount of toner to be transferred onto the recoding sheet decreases such that the amount of collected toner increases.

When the image processing apparatus performs successive printing operations under either or both of the above scenarios, toner may overflow from the full collected toner container before the toner cartridge is emptied.

SUMMARY

In view of the above, there is a need for a technique of estimating the amount of collected toner with improved accuracy, while taking into account a printing condition of printing operation performed by the image processing apparatus.

Example embodiments of the present invention include an apparatus, method, system, computer program and product each capable of controlling an image processing apparatus having a collected toner container in which residual toner is accumulated. The control is performed by: obtaining a supplied toner amount indicating an amount of toner supplied to a developing unit of the image processing apparatus; obtaining a total number of printed sheets generated by the image processing apparatus; calculating an average number of printed sheets per image forming job; calculating an average printing ratio indicating an average of printing ratios of the printed sheets, based on the supplied toner amount, the total number of printed sheets, and the average number of printed sheets per image forming job; calculating a collected toner amount indicating an amount of toner accumulated in the collected toner container of the image processing apparatus based on the average number of printed sheets per image forming job and the average printing ratio; and comparing the collected toner amount with a threshold value to generate a comparison result. Based on the comparison result, whether to stop image forming operation or whether to replace the collected toner container is determined.

In addition to the above-described example embodiments, the present invention may be practiced in various other ways.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 5 is an example table used for estimating the amount of collected toner, stored in the image processing apparatus of FIG. 1.

Figure 1:
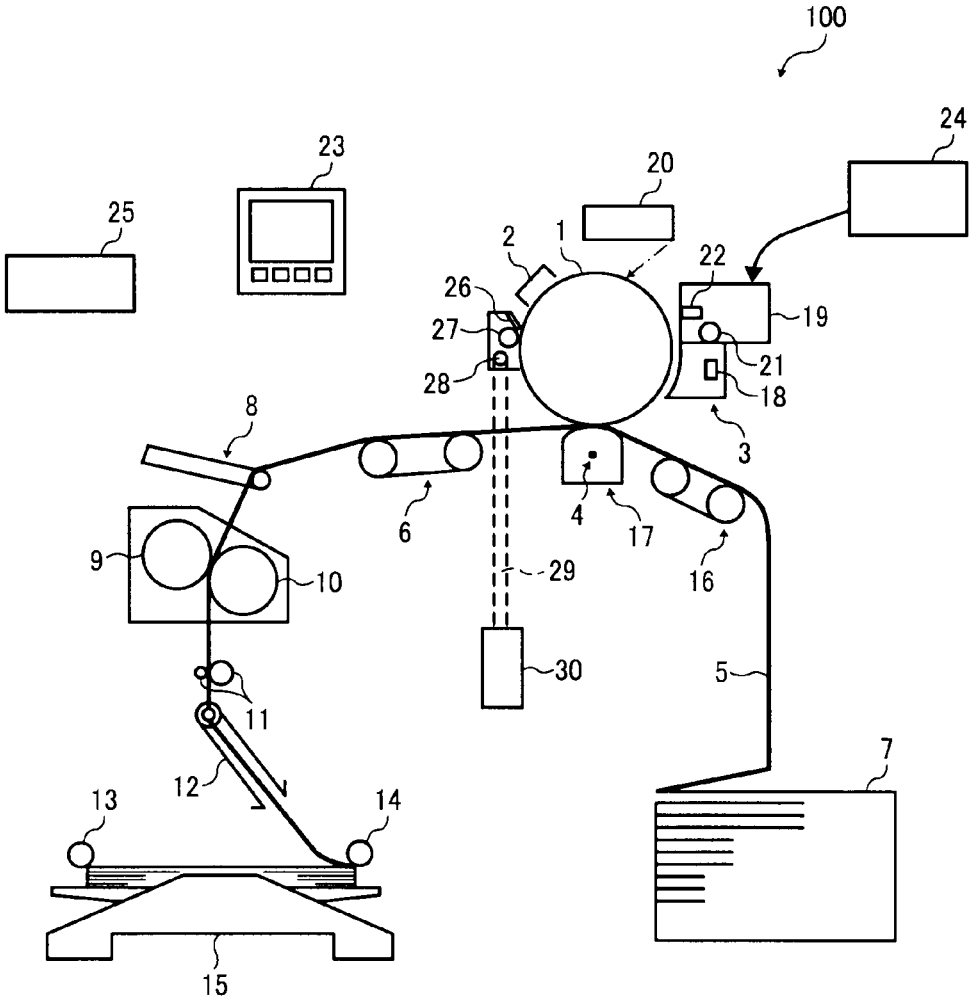
FIG. 1 is a schematic block diagram illustrating a selected portion of an image processing apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring to FIG. 1, a selected portion of an image processing apparatus 100 is explained according to an example embodiment of the present invention. In this example, the image processing apparatus 100 is implemented as an image forming apparatus capable of forming an image using electrophotographic method.

The image processing apparatus 100 includes an optical writing device 20 that functions as a latent image forming device, a photoconductive drum 1 that functions as an image carrier such as a photoconductor, a charger 2, a developing unit 3, a transfer device 4, a first tractor 6, a sheet hopper 7, a buffer 8, a heating roller 9, a pressure roller 10, a transfer roller pair 11, a swing fin 12, a first paddle 13, a second paddle 14, a stacker table 15, a second tractor 16, a retractor 17, a toner density detector 18, a toner hopper 19, a toner supply roller 21, a toner empty detector 22, an operation panel 23, a toner cartridge 24, a microprocessor 25, a cleaning blade 26, a cleaning brush 27, a screw 28, a toner pipe 29, and a collected toner container 30.

In example operation, the image processing apparatus 100 is connected to a host computer, for example, through a network. When the image processing apparatus 100 receives an image forming signal including dot data from the host computer, the optical writing device 20 irradiates and scans a laser light onto a surface of the photoconductive drum 1 according to the dot data.

The charger 2 uniformly charges the surface of the photoconductive drum 1. The portion of the surface of the photoconductive drum 1, which receives the laser light, is discharged to form a latent image thereon. The developing unit 3 supplies toner to the latent image to develop the latent image into a toner image. The transfer device 4 transfers the toner image to a recording sheet 5.

The recording sheet 5, which is transferred from the sheet hopper 7, is transferred to the transfer device 4 through the second tractor 16 at a constant transfer speed. The retractor 17, which is movable in the upward and downward direction, presses the recording sheet 5 through the transfer device 4 against the surface of the photoconductive drum 1. At the transfer device 4, the toner image formed on the surface of the photoconductive drum 1 is transferred onto the recording sheet 5.

After the recording sheet 5 formed with the toner image is transferred through the first tractor 6 and the buffer 8, the recording sheet 5 passes through a nip formed between the heating roller 9 and the pressure roller 10. At the nip, the toner image formed on the recording sheet 5 is fixed onto the recording sheet 5 by heat and pressure. The recording sheet 5 having the fixed image thereon is transferred by the transfer roller pair 11 through a swing fin 12 to the stacker table 15. The recording sheet 5 conveyed to the stacker table 15 is aligned by the first paddle 13 and the second paddle 14.

The developing unit 3 is provided with the toner density detector 18, which detects toner density of toner in the developing unit 3, based on a ratio of the toner with respect to a carrier. When the toner density is lower than a threshold, the developing unit 3 drives the toner supply roller 21 for a predetermined time to supply toner from the toner hopper 19 into the developing unit 3 so as to maintain the toner density in the developing unit 3 at a predetermined level. This operation of maintaining the toner density level is controlled by the microprocessor 25.

The microprocessor 25 is implemented as a processor and a memory, and provided with a plurality of functions including the function of detecting a supplied toner amount, counting a number of printed pages, calculating an average number of printed pages per job, calculating an average printing ratio, calculating a collected toner amount, comparing the collected toner amount with a threshold value to generate a comparison result, stopping printing operation based on the comparison result, and generating notification based on the comparison result.

For example, in order to perform the function of detecting the supplied toner amount, the microprocessor 25 is provided with a counter or a timer that counts a time in which the toner supply roller 21 is driven. Based on the time for driving the toner supply roller 21, the microprocessor 25 determines the amount of toner supplied from the toner hopper 19 into the developing unit 3. Further, in this example, the function of detecting the supplied toner amount is provided with a function of comparing the supplied toner amount that is counted using the timer or the counter, with a threshold that is previously set and stored in a memory such as the memory of the microprocessor 25.

In order to count a number of printed pages, the microprocessor 25 is provided with a counter that counts a number of printed pages that have been printed by the image processing apparatus 100.

In order to calculate an average number of printed pages per job, the microprocessor 25 is provided with a calculator that calculates an average number of printed pages per job. In this example, the average number of printed pages per job indicates how much degree the image forming unit is used for actual printing operation when performing an image forming job. For example, as described below referring to FIG. 4, the microprocessor 25 calculates the average number of printed pages per job based on the counted number of printed pages and the time for driving the developing unit 3.

In order to calculate an average printing ratio, the microprocessor 25 is provided with a calculator that calculates an average printing ratio of the printed pages that have been counted. For example, the microprocessor 25 calculates the average printing ratio based on the average number of printed pages per job, and the supplied toner amount.

In order to calculate a collected toner amount, the microprocessor 25 is provided with a calculator that calculates the amount of toner collected into the collected toner container 30. For example, the microprocessor 25 calculates the amount of collected toner, based on the average number of printed pages per job and the average printing ratio.

In order to perform comparison, the microprocessor 25 is provided with a comparator that compares the collected toner amount that is calculated with a threshold value that is previously set and stored in a memory such as the memory of the microprocessor 25 to generate a comparison result.

The microprocessor 25 is provided with the function of stopping printing operation based on the comparison result. For example, when the comparison result generated by the comparison function or the comparator indicates that the collected toner amount that is calculated is greater than the threshold value, the microprocessor 25 causes an image forming unit of the image processing apparatus 100 to stop printing operation. In this example, the image forming unit includes the photoconductive drum 1, the charger 2, the developing unit 3, etc., which together perform operation of printing.

The microprocessor 25 is provided with the function of generating notification based on the comparison result. For example, when the comparison result generated by the comparison function or the comparator indicates that the collected toner amount that is calculated is greater than the threshold value, the microprocessor 25 notifies the operator, for example, by requesting the operator to replace the collected toner container 30. In one example, the microprocessor 25 causes the operation panel 23 of the image processing apparatus 100 to display an alert message.

Referring to FIG. 1, operation of controlling printing operation, performed by the image processing apparatus 100, is explained according to an example embodiment of the present invention.

In this example, the toner hopper 19 is provided with the toner empty detector 22 in its inside. The toner empty detector 22 determines that toner in the toner cartridge 24 installed onto the toner hopper 19 is empty, for example, when the amount of toner in the toner hopper 19 becomes lower than a threshold value, and sends notification to the microprocessor 25. When the microprocessor 25 determines that toner in the toner hopper 21 is empty as it receives notification from the toner empty detector 22, the microprocessor 25 causes the image forming unit to stop printing operation. Further, the microprocessor 25 causes the operation panel 23 to display a message indicating that toner is empty or is most likely to be empty in the near future. For example, the microprocessor 25 displays a message requesting the operator to replace the toner cartridge 24 with a new one. With this message, the operator removes the toner cartridge 24 that is determined to be empty from the toner hopper 19, and installs a new toner cartridge 24 onto the toner hopper 19.

The toner that is supplied by the toner cartridge 24 ends up as the toner transferred onto the recording sheet 5 as a part of the image, or ends up as the residual toner that remains on the photoconductive drum 1. The residual toner that remains on the surface of the photoconductive drum 1 after the transfer device 4 transfers the toner image onto the recording sheet 5 is removed by the cleaning blade 26 and the cleaning brush 27 from the surface of the photoconductive drum 1, and transferred by the screw 28 into the toner pipe 29 to the collected toner container 30, and stored into the collected toner container 30.

The collected toner container 30 may be replaced with a new one at the same time when toner is replenished by replacing the toner cartridge 24. More specifically, when the message for requesting replacement of the toner cartridge 24 is received, the operator is requested to replace the collected toner container 30 in addition to the toner cartridge 24. When the toner empty detector 22 detects that toner is replenished, for example, by replacement of the toner cartridge 24, the microprocessor 25 causes the operation panel 23 to display a message requesting the operator to replace the collected toner container 30. With this message, the operator is able to replace the collected toner cartridge 30 with a new one.

However, in the above-described method of replacing the collected toner container 30 at the same time the toner cartridge 24 is replaced, the amount of collected toner stored in the collected toner container 30 at the time of replacement may be low as 40% of the total amount of toner collectable by the collected toner container 30, depending on a printing condition in which printing operation is performed by the image processing apparatus 100, such as the printing mode and/or the printing ratio of the printing operation. This shortens the usage life of the collected toner container 30. On the other hand, if the image processing apparatus 100 successively performs printing with less number of pages per printing job and/or with relatively low printing ratio, the amount of collected toner stored in the collected toner container 30 may exceed the total amount of toner collectable by the collected toner container 30 before the toner cartridge 24 is replaced, such that an excessive amount of toner may overflow from the collected toner container 30. In order to prevent overflow of collected toner or extend the usage of the collected toner container 30, the collected toner container 30 needs to be replaced at a time that is determined independently from the time the toner cartridge 24 is replaced under some circumstances.

Figure 2:
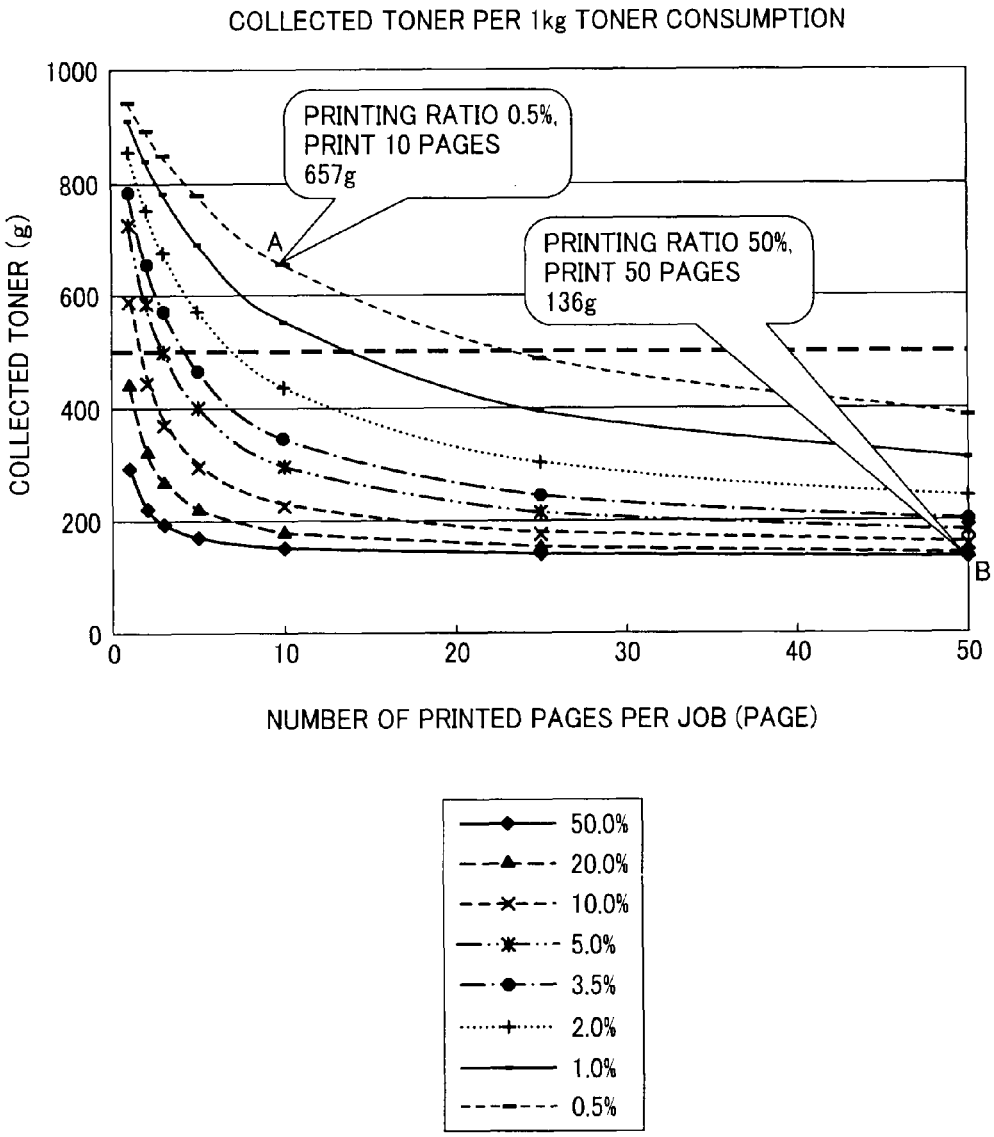
FIG. 2 is a graph illustrating a relationship between an average number of printed pages per job and the amount of collected toner, obtained using the image processing apparatus of FIG. 1.

FIG. 2 is a graph illustrating the relationship between an average number of pages per one job and an amount of collected toner in the collected toner container 30, which is obtained using the image processing apparatus 100 of FIG. 1. Referring to FIG. 2, the vertical axis indicates the average number of pages per one job in number of pages, and the horizontal axis indicates the amount of collected toner in gram. In this example illustrated in FIG. 2, the toner cartridge 24 contains therein 1000 g of toner. The graph of FIG. 2 indicates the relationship between the average number of pages per one job and the amount of collected toner, until 1000 g of toner in the toner cartridge 24 is consumed, respectively for the average printing ratios of 50%, 20%, 10%, 5%, 3.5%, 2%, 1%, and 0.5%.

Further, in this example, in a printing mode that is set by default ("default printing mode"), the image processing apparatus 100 prints more than 1000 pages per job with the printing ratio of 3.5%. In the default printing mode, although not shown in FIG. 2, the amount of collected toner is about 200 g when 1000 g of toner is consumed.

Referring to FIG. 2, the amount of collected toner differs depending on the average number of printing pages per job and the average printing ratio. More specifically, the graph of FIG. 2 indicates that the amount of collected toner tends to increase with the decrease in average printing ratio and the decrease in average number of printed pages per job. For example, the point A in the graph of FIG. 2 indicates that the amount of collected toner is 657 g when the average printing ratio is 0.5% and the average number of printed pages is 10 pages. The point B in the graph of FIG. 2 indicates that the amount of collected toner is 136 g when the average printing ratio is 50% and the average number of printed pages is 50 pages.

Figure 4:
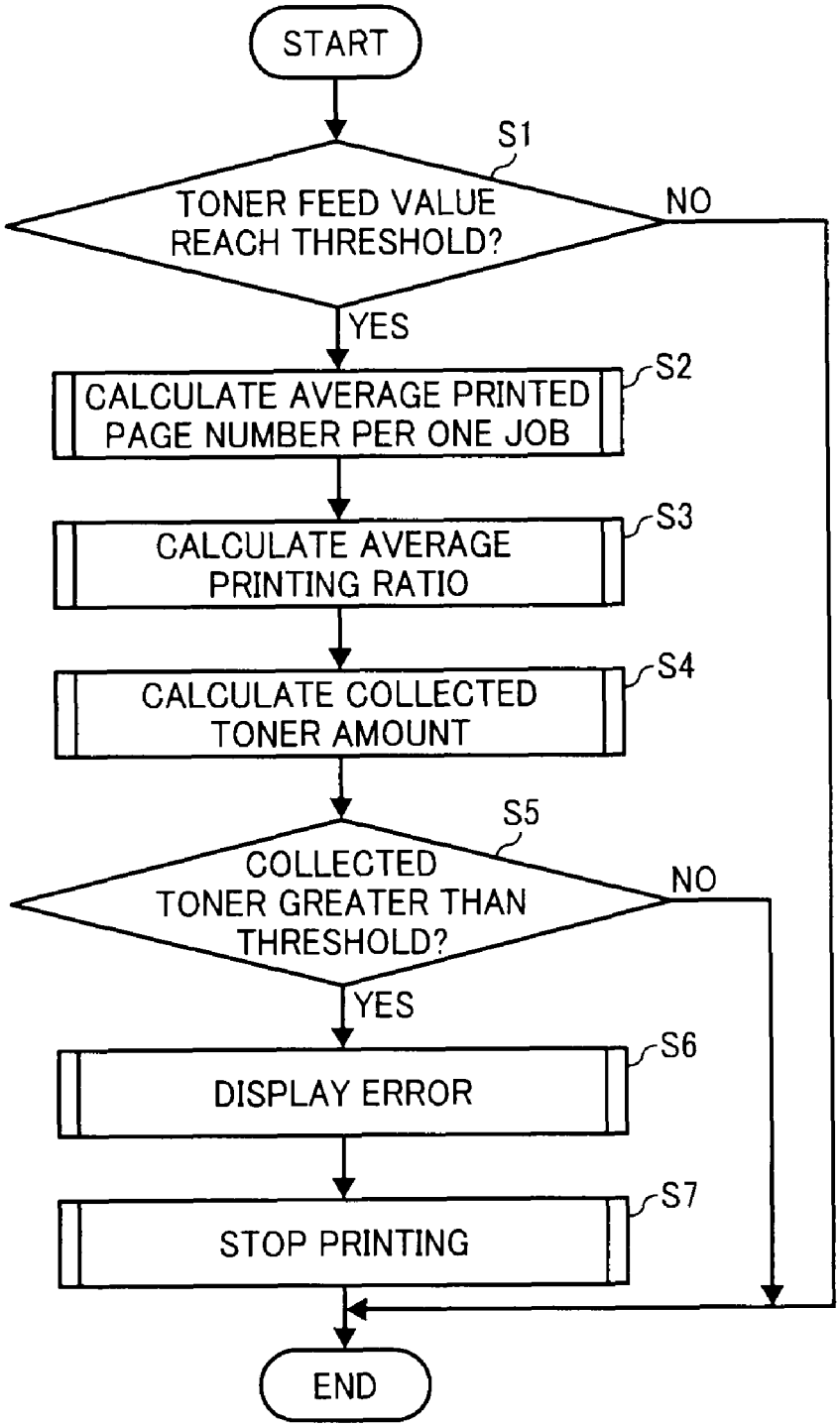
FIG. 4 is a flowchart illustrating operation of estimating an amount of collected toner collected in the image processing apparatus of FIG. 1, according to an example embodiment of the present invention.

Referring to FIG. 4, operation of estimating the amount of collected toner and controlling operation of the image processing apparatus 100, performed by the microprocessor 25, is explained according to an example embodiment of the present invention. In this example, the microprocessor 25 estimates the amount of collected toner collected in the image processing apparatus 100 based on the average printing ratio and the average number of printed pages per job, using the relationship illustrated in FIG. 2. Based on the estimated amount of collected toner, the microprocessor 25 determines whether the collected toner container 30 is full of collected toner.

The operation of FIG. 4 may be performed every time the toner supply roller 21 is driven to supply toner into the developing unit 3 to keep the toner density at a predetermined level, after the toner density is detected to have a level lower than the predetermined level. However, since the amount of toner supplied at one time is relatively small, the operation of FIG. 4 may be performed only when the accumulated amount of toner supplied by the toner supply roller 21 reaches a predetermined level. In this example, assuming that the toner hopper 19 contains 1000 g of toner, the operation of FIG. 4 is performed when the amount of toner supplied reaches 500 g, 700 g, and 900 g.

More specifically, at S1, the microprocessor 25 calculates the amount of supplied toner supplied from the toner hopper 19 into the developing unit 3 based on the time in which the toner supply roller 21 is driven, as a toner feed amount or supplied toner amount. The microprocessor 25 compares the calculated supplied toner amount with a predetermined threshold value, which is either one of 500 g, 700 g, and 900 g. When it is determined that the supplied toner amount reaches the threshold value ("YES" at S1), the operation proceeds to S2. When it is determined that the supplied toner amount does not reach the threshold value ("NO" at S1), the operation ends without estimating the amount of collected toner.

At S2, the microprocessor 25 calculates an average number of printed pages per job, which is the average number of printed pages that are sequentially printed in one printing job. The microprocessor 25 may calculate the average number of printing pages in various ways, for example, as follows.

The microprocessor 25 obtains a number of printed pages that is counted using a counter as a counted number of printed pages ("counted number A"), and a number of printed pages that is converted from a time for driving the developing unit 3 as a calculated number of printed pages B ("calculated number B"). At the time of starting printing operation and at the time of ending the printing operation, the image forming unit of the image processing apparatus 100 such as the photoconductive drum 1 and the developing unit 3 is driven for a predetermined time period while not forming any images. The average number of printed pages per job is obtained by dividing the counted number A by the calculated number B. For example, assuming that the time for driving the developing unit 3 at the time of starting printing operation and at the time of ending printing operation is 10 seconds, and the time required for performing printing operation per page is one second, the average number of printed pages per job is A/B=1/10=10% when only one page is printed. In the case of printing 5 pages, the average number of printed pages per job is A/B=5/10 pages=50%. With the ratio between the number of printed pages and the time for driving the developing unit 3, the microprocessor 25 obtains the average number of printed pages per job. In one example, the microprocessor 25 calculates the ratio between the number of printed pages and the time for driving the developing unit 3, and obtains the average number of printed pages using a look-up table. In another example, the microprocessor 25 calculates the average number of printed pages using the formula: A/B*Ka, where Ka is a constant value.

At S3, the microprocessor 25 calculates the average printing ratio, which is an average value of printing ratios respectively obtained for the printed pages that are counted. The average printing ratio may be calculated based on the counted number of printed pages and the average number of printed pages per job that are respectively obtained at S2, and the supplied toner amount that is obtained at S1.

In order to accurately calculate the printing ratio, a number of pixels contained in the dot data that is received from the host computer or any other device is obtained using a counter. In absence of the counter, in this example, the printing ratio is calculated based on the number of printed pages and the supplied toner amount. More specifically, the amount of toner consumed per page is obtained using the number of printed pages and the supplied toner amount. Based on the amount of toner consumed per page, the printing ratio can be estimated relatively easily. However, in reality, the amount of toner consumed differs depending on the average number of printed pages per job, for example, as illustrated in FIG. 3.

Figure 3:
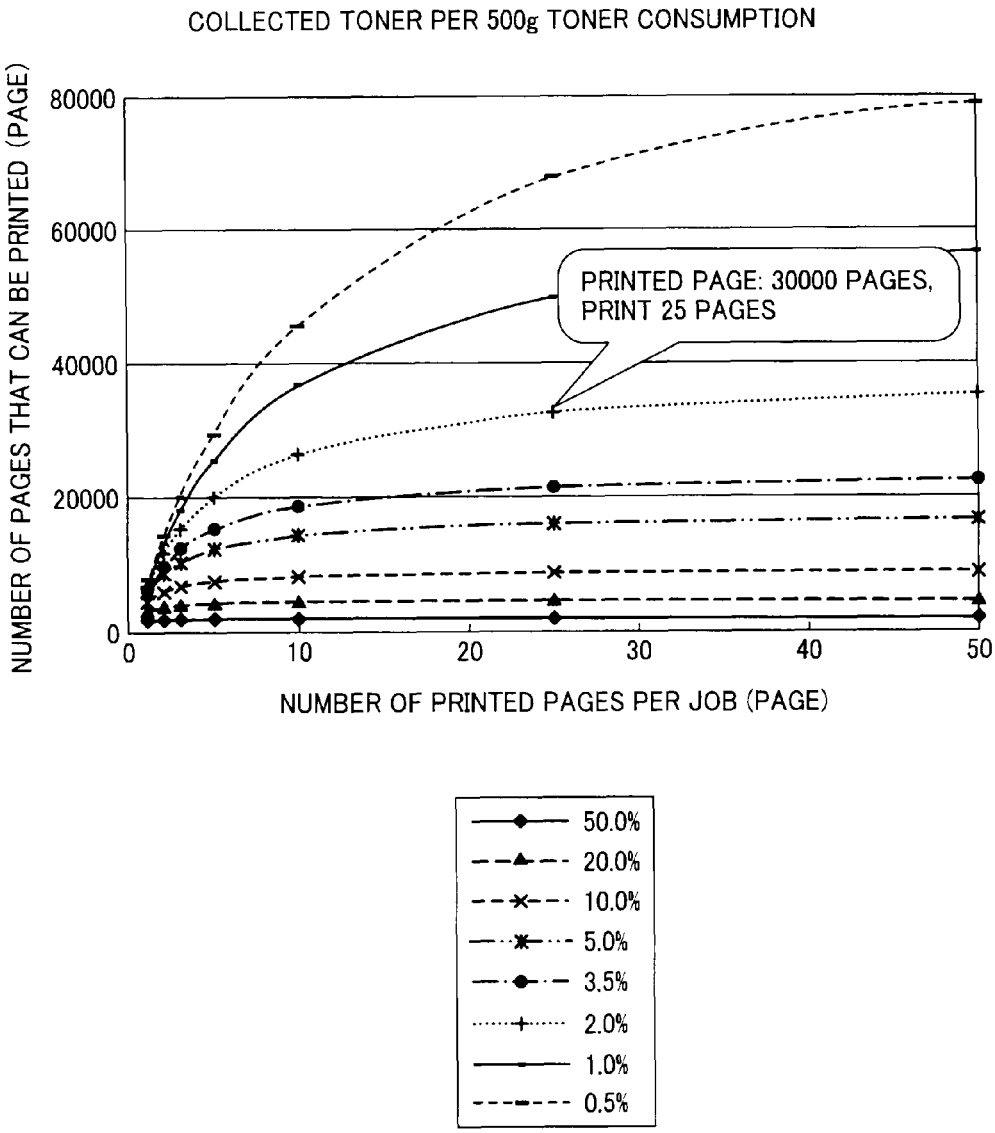
FIG. 3 is a graph illustrating a relationship between an average number of printed pages per job and a number of pages that can be printed, obtained using the image processing apparatus of FIG. 1.

FIG. 3 is a graph illustrating the number of printed pages as 500 g of toner is consumed. The horizontal axis of FIG. 3 indicates an average number of printed pages per job expressed in pages, and the vertical axis of FIG. 3 indicates a number of pages that can be printed expressed in pages. Referring to FIG. 3, the number of printed pages, which is shown by the vertical axis, changes in relation to the average printing ratio and the average number of printed pages per job. Using this relationship indicated by FIG. 3, the average printing ratio can be calculated based on the supplied toner amount, the average number of printed pages per job, and the number of printed pages. For example, in the case in which 500% toner is supplied, the number of printed pages is 30,000 pages, and the average number of printed pages per job is 25 pages, the average printing ratio is 2%. In alternative to the graph of FIG. 2, the microprocessor 25 may previously store a lookup table indicating the relationship shown in FIG. 2. The lookup table stores a plurality of average printing ratios respectively corresponding to the average numbers of printed pages per job and the number of printed pages, each of which is prepared for a specific toner supplied amount. More specifically, the image processing apparatus 100 may be provided with a plurality of lookup tables prepared for a plurality of toner supplied amounts, each table correlating an average printing ratio with an average number of printed pages per job and a number of printed pages.

At S4, the microprocessor 25 calculates the amount of collected toner, based on the average number of printed pages per job that is obtained at S2, and the average printing ratio obtained at S3. More specifically, using these values of the average number of printed pages per job and the average printing ratio, the amount of collected toner can be estimated using the relationship indicated by the graph of FIG. 2. More specifically, the image processing apparatus 100 previously stores a lookup table of FIG. 5, and obtains the amount of collected toner using the lookup table of FIG. 5. For example, in the case where the average printing ratio is 5% and the average number of printed pages per job is 2 pages, the amount of collected toner is 409 g.

At S5, the microprocessor 25 compares the amount of collected toner calculated at S4 with a predetermined threshold value. When it is determined that the amount of collected toner reaches the predetermined threshold value ("YES" at S5), the microprocessor 25 determines that the collected toner container 30 is full of collected toner, and the operation proceeds to S6. When it is determined that the amount of collected toner is less than the predetermined threshold value ("NO" at S5), the operation ends.

The threshold value used at S5 is previously set as a value for preventing toner from overflowing the collected toner container 30, and it is different from the threshold value used at S1. For example, the threshold value may be set at 60% to 90% of a maximum toner level that can be stored in the collected toner container 30.

At S6, the microprocessor 25 causes the operation panel 23 to display a message requesting the operator to replace the collected toner container 30.

At S7, the microprocessor 25 stops printing operation so as to prevent toner from overflowing from the collected toner container 30, and the operation ends.

When the operator replaces the collected toner container 30 with new one, the microprocessor 25 determines that the collected toner container 30 is not full. When the microprocessor 25 determines that the collected toner container 30 is not full, the microprocessor 25 clears the message that has been displayed onto the operation panel 23, and resets the calculated data obtained at previous steps of S1 to S7 such as the average number of printed pages per job, the average printing ratio, the amount of collected toner, etc., and wait for next operation of FIG. 4 to be performed.

The operation of FIG. 4 may be performed in various other ways. For example, at S5, in addition to comparing the amount of collected toner with the predetermined threshold value, the microprocessor 25 may determine whether the toner hopper 19 is empty. More specifically, when it is determined that the amount of collected toner reaches the threshold value and the toner hopper 19 is empty, the microprocessor 25 may cause the operation panel 23 to display a message requesting the operator to replace the collected toner container 30 and the toner cartridge 24.

Further, any one of the calculated values may be stored in a memory of the image processing apparatus 100 or any other memory accessible by the microprocessor 25. For instance, the calculated values including any combination of the average number of printed pages per job, the average printing ratio, and the collected toner amount may be stored in the form of table. Based on these values, the image processing apparatus 100 may be able to show information indicating the trend in these values, which may be used for further analysis. Alternatively or additionally, these values stored in the memory may be used as train data that is used for generating or updating a table such as the look-up table of FIG. 5. These values are reset when the microprocessor 25 determines that the collected toner container 30 is replaced with a new one.

As described above, the image processing apparatus 100 is able to estimate the amount of collected toner stored in the collected toner container 30 with improved accuracy, while considering a printing condition of the image processing apparatus 100 such as the printing mode or the printing ratio. Accordingly, the image processing apparatus 100 is able to notify the user to replace the collected toner container 30 before the collected toner container 30 becomes full.

Further, in this example, the image processing apparatus 100 may display information regarding the amount of collected toner on the operation panel 23 before the collected toner container 30 becomes full, and notifies the operator when the collected toner container 30 is most likely to become full of collected toner. For example, by setting the threshold value that is used for comparison with the calculated collected toner amount to a value less than the value usually set, the image processing apparatus 100 is able to notify the operator before the collected toner container 30 becomes full. In this example, the value that is usually set is determined based on a maximum level of toner that can be stored in the collected toner container 30.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

In one example, any one of the above-described operations performed by the image processing apparatus 100 may be performed either sequentially or concurrently, depending on the processing capability of the image processing apparatus 100 or the microprocessor 25.

In another example, the operation of FIG. 4 may be performed by any desired apparatus other than the image processing apparatus 100, which controls image processing operation of the image processing apparatus 100. For example, the image processing apparatus 100 may be connected to an information processing apparatus via a network. The information processing apparatus is provided with a processor and a memory, which together function as the microprocessor 25. In such case, the image processing apparatus 100 does not have to be provided with an image processing control program that causes the microprocessor 25 to perform the function of estimating a collected toner amount. More specifically, at a predetermined timing, the image processing apparatus 100 requests the information processing apparatus to start communication. In response to the request, the information processing apparatus 100 requests the image processing apparatus 100 to send information regarding printing operation performed by the image processing apparatus such as a supplied toner amount and a total number of printed pages. Based on the information obtained from the image processing apparatus 100, the information processing apparatus calculates an average number of printed pages per job. The information processing apparatus further calculates an average printing ratio based on the supplied toner amount, the number of printed pages, and the average number of printed pages per job. The information processing apparatus further calculates a collected toner amount based on the average number of printed pages per job and the average printing ratio. When the collected toner amount that is calculated is greater than a threshold value previously set, the information processing apparatus determines that replacement of the collected toner container 30 is necessary. In such case, the information processing apparatus requests the operator to replace the collected toner container 30. Further, the information processing apparatus communicates with the image processing apparatus 100 to cause the operation panel 23 to display an error message as well as stopping printing operation of the image processing apparatus 100.

Further, the above-described operation of estimating an amount of collected toner may be applied to a different area of technology, as long as it is desirable. For example, in alternative to collected toner amount, any consumable material may be monitored using the above-described technique.

Further, as described above, any one of the above-described and other methods of the present invention may be embodied in the form of a computer program stored in any kind of storage medium at least temporarily. Examples of storage mediums include, but are not limited to, semiconductor memory, flexible disk, hard disk, optical discs such as CD-ROM or DVD, magneto-optical discs, magnetic tapes or disks, involatile memory cards, ROM (read-only-memory), etc. Further, such computer program or any storage medium storing such computer program may be provided as package software.

In alternative to installing the computer program from the storage medium onto a computer, the computer program may be transferred to the computer through a network such as wired or wireless network such as local area network (LAN) or the Internet. The computer program that is downloaded is stored in a storage device of the computer such as a hard disk drive.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in: an image processing apparatus that collects residual toner resided on a surface of an image carrier into a collected toner container. The image processing apparatus includes: means for obtaining a supplied toner amount indicating an amount of toner supplied to a developing unit that forms a toner image on a surface of the image carrier; means for obtaining a number of printed pages; means for calculating an average number of pages that are sequentially printed per one job; means for calculating an average printing ratio indicating an average number of printing ratios respectively obtained for the printed pages based on the supplied toner amount, the number of printed pages, and the average number of printed pages per job; means for calculating a collected toner amount indicating an amount of toner collected in the collected toner container based on the average number of printed pages per job and the average printing ratio; means for comparing the collected toner amount with a threshold value; and means for stopping printing operation when the means for comparing indicates that the collected toner amount is greater than the threshold value. The threshold value is previously set as a value that prevents toner collected in the collected toner container from overflowing.

In the above-described example, the image processing apparatus may be provided with means for sending notification that requests an operator to replace the collected toner container when the collected toner amount is greater than the threshold value.

In the above-described example, the means for calculating an average number of printed pages per job calculates a ratio between the number of printed pages and a time for driving the developing unit, based on the number of printed pages obtained by the means for obtaining a number of printed pages, and a number of printed pages that is converted from a time for driving the developing unit. The means for calculating an average number of printed pages calculates the average number of printed pages per one job, based on the supplied toner amount and the ratio between the number of printed pages and the time for driving the developing unit.

In the above-described example, the means for calculating an average number of printing ratios uses a lookup table to refer to an average printing ratio that corresponds to an average number of printed pages per job and a number of printed pages, classified by the toner supply amount.

In the above-described example, the means for calculating an average number of pages, the means for calculating an average number of printing ratios, the means for calculating an amount of toner collected in the collected toner container, and the means for comparing, respectively perform calculation every time a predetermined amount of toner is supplied.

The calculation result of the means for calculating an average number of pages, the calculation result of the means for calculating an average number of printing ratios, and the calculation result of the means for calculating an amount of toner collected in the collected toner container are respectively reset when the collected toner container is replaced.

In another example, the present invention may reside in: a method of controlling an image processing apparatus, preformed by the image processing apparatus that collects residual toner resided on a surface of an image carrier into a collected toner container. The image processing control method includes: obtaining a supplied toner amount indicating an amount of supplied toner supplied to a developing unit that forms a toner image on a surface of the image carrier; obtaining a number of printed pages; calculating an average number of printed pages that are sequentially printed per one job; calculating an average printing ration indicating an average number of printing ratios respectively obtained for the printed pages based on the supplied toner amount, the number of printed pages, and the average number of printed pages per job; calculating a collected toner amount indicating an amount of toner collected in the collected toner container based on the average number of printed pages per job and the average printing ratio; comparing the collected toner amount with a threshold value; and stopping printing operation when the comparing indicates that the collected toner amount is greater than the threshold value. The threshold value is previously set as a value that prevents toner collected in the collected toner container from overflowing.

In another example, the present invention may reside in an image processing control program stored in a recording medium, which causes a processor to perform any one of the above-described image processing control method.

In another example, the present invention may reside in a recording medium storing a plurality of instructions that cause a processor to perform any one of the above-described image processing control method.

For example, the present invention may reside in: a recording medium storing a plurality of instructions which cause, when executed, a processor to perform a method of controlling an image processing apparatus having a collected toner container in which residual toner is accumulated, the method including: obtaining a supplied toner amount indicating an amount of toner supplied to a developing unit of the image processing apparatus; obtaining a total number of printed sheets generated by the image processing apparatus; calculating an average number of printed sheets per image forming job; calculating an average printing ratio indicating an average of printing ratios of the printed sheets, based on the supplied toner amount, the total number of printed sheets, and the average number of printed sheets per image forming job; calculating a collected toner amount indicating an amount of toner accumulated in the collected toner container of the image processing apparatus based on the average number of printed sheets per image forming job and the average printing ratio; comparing the collected toner amount with a threshold value to generate a comparison result; and causing the image processing apparatus to stop forming of the toner image when the comparison result indicates that the collected toner amount exceeds the threshold value.

What is claimed is:

1. An image processing apparatus, comprising:

an image forming unit configured to form a toner image on a surface of an image carrier using a developing unit;

a toner supply unit configured to supply toner from a toner storage unit to the developing unit;

a transfer unit configured to transfer the toner image from the image carrier onto a recording sheet to generate a printed sheet;

a toner collecting unit configured to collect residual toner that resides on the surface of the image carrier after transferring of the toner image, and to accumulate the residual toner into a collected toner container; and a controller unit configured to control an image forming job of generating the printed sheet, the controller unit further configured to:

obtain a supplied toner amount indicating an amount of toner supplied by the toner supply unit to the developing unit;

obtain a total number of printed sheets generated by the image forming unit and the transfer unit;

calculate an average number of printed sheets per image forming job;

calculate an average printing ratio indicating an average of printing ratios of the printed sheets, based on the supplied toner amount, the total number of printed sheets, and the average number of printed sheets per image forming job;

calculate a collected toner amount indicating an amount of toner accumulated in the collected toner container based on the average number of printed sheets per image forming job and the average printing ratio;

compare the collected toner amount with a threshold value to generate a comparison result; and cause the image forming unit to stop forming of the toner image when the comparison result indicates that the collected toner amount exceeds the threshold value.

2. The apparatus of claim 1, further comprising:

a memory configured to store a table correlating a collected toner amount with an average printing ratio and an average number of printed sheets per image forming job, wherein the controller unit is configured to calculate the collected toner amount using the table stored in the memory.

3. The apparatus of claim 1, wherein the controller unit includes:

a counter configured to count the total number of printed sheets to generate a counted number of printed sheets; and a calculator configured to obtain a calculated number of printed sheets from a time for driving the developing unit, wherein the controller unit is further configured to calculate a ratio between the counted number of printed sheets and a time for driving the developing unit, based on the counted number of printed sheets and the calculated number of printed sheets, and to calculate the average number of printed sheets per image forming job based on the supplied toner amount, and the ratio between the counted number of printed sheets and the time for driving the developing unit.

4. The apparatus of claim 1, further comprising:

a memory configured to store a plurality of tables respectively prepared for a plurality of toner supply amounts, each table correlating an average printing ratio with an average number of printed sheets per image forming job and a number of printed sheets, wherein the controller unit is configured to calculate the average printing ratio using the table stored in the memory.

5. The apparatus of claim 1, wherein the controller unit includes:

a calculator configured to calculate an amount of toner consumed per printed sheet based on the supplied toner amount and the total number of printed sheets, and the controller unit is further configured to calculate the average printing ratio based on the average number of printed sheets per image forming job and the amount of toner consumed per printed sheet.

6. The apparatus of claim 1, wherein the controller unit is further configured to determine whether the supplied toner amount reaches a predetermined value, and to perform calculation of the average number of printed sheets per image forming job, the average printing ratio, and the collected toner amount, and comparison, only when the controller unit determines that the supplied toner amount reaches the predetermined value.

7. The apparatus of claim 1, further comprising:

a user interface unit configured to generate notification requesting replacement of the collected toner container when the comparison result indicates that the collected toner amount exceeds the threshold value.

8. The apparatus of claim 7, wherein the controller unit is further configured to store the average number of printed sheets per image forming job, the average printing ratio, and the collected toner amount in a memory.

9. The apparatus of claim 8, wherein the controller unit is further configured to determine whether the collected toner container is replaced, and to reset the average number of printed sheets per image forming job, the average printing ratio, and the collected toner amount, which are respectively stored in the memory, when the controller determines that the collected toner container is replaced.

10. The apparatus of claim 1, further comprising:

a toner empty detector provided in the developing unit to determine whether the toner storage unit is empty or is most likely to be empty in the near future, wherein the controller further causes the user interface unit to generate notification requesting replacement of the collected toner container when the toner empty detector determines that the toner storage unit is empty or is most likely to be empty.

11. A method of controlling an image processing apparatus having a collected toner container in which residual toner is accumulated, the method comprising:

obtaining a supplied toner amount indicating an amount of toner supplied to a developing unit of the image processing apparatus;

obtaining a total number of printed sheets generated by the image processing apparatus;

calculating an average number of printed sheets per image forming job;

calculating an average printing ratio indicating an average of printing ratios of the printed sheets, based on the supplied toner amount, the total number of printed sheets, and the average number of printed sheets per image forming job;

calculating a collected toner amount indicating an amount of toner accumulated in the collected toner container of the image processing apparatus based on the average number of printed sheets per image forming job and the average printing ratio;

comparing the collected toner amount with a threshold value to generate a comparison result; and causing the image processing apparatus to stop forming of the toner image when the comparison result indicates that the collected toner amount exceeds the threshold value.

12. The method of claim 11, further comprising:

counting the total number of printed sheets to generate a counted number of printed sheets;

obtaining a calculated number of printed sheets from a time for driving the developing unit of the image processing apparatus;

calculating a ratio between the counted number of printed sheets and a time for driving the developing unit, based on the counted number of printed sheets and the calculated number of printed sheets; and calculating the average number of printed sheets per image forming job based on the supplied toner amount, and the ratio between the counted number of printed sheets and the time for driving the developing unit.

13. The method of claim 11, further comprising:

storing, in a memory, a plurality of tables respectively prepared for a plurality of toner supply amounts, each table correlating an average printing ratio with an average number of printed sheets per image forming job and a number of printed sheets, wherein the average printing ratio is calculated using the table stored in the memory.

14. The method of claim 11, further comprising:

generating notification requesting replacement of the collected toner container when the comparison result indicates that the collected toner amount exceeds the threshold value.

15. An image processing system, comprising:

an image processing apparatus having a developing unit, and a collected toner container in which residual toner is accumulated; and a controller device configured to control the image processing apparatus, the controller device further configured to:

obtain a supplied toner amount indicating an amount of toner supplied to the developing unit of the image processing apparatus;

obtain a total number of printed sheets generated by the image processing apparatus;

calculate an average number of printed sheets per image forming job;

calculate an average printing ratio indicating an average of printing ratios of the printed sheets, based on the supplied toner amount, the total number of printed sheets, and the average number of printed sheets per image forming job;

calculate a collected toner amount indicating an amount of toner accumulated in the collected toner container of the image processing apparatus based on the average number of printed sheets per image forming job and the average printing ratio;

compare the collected toner amount with a threshold value to generate a comparison result; and cause the image processing apparatus to stop forming of the toner image when the comparison result indicates that the collected toner amount exceeds the threshold value.

* * * * *